US005477109A

United States Patent [19]

Chermin et al.

[11] Patent Number: 5,477,109

[45] Date of Patent: Dec. 19, 1995

[54] DISCHARGE LAMP FAST PREHEAT CIRCUIT INDEPENDENT OF TYPE OF BALLAST

[75] Inventors: Hubertus M. J. Chermin; Ronald Siepkes, both of Eindhoven, Netherlands

[73] Assignee: U.S. Philips Corporation, New York, N.Y.

[21] Appl. No.: 320,038

[22] Filed: Oct. 7, 1994

[30] Foreign Application Priority Data

Oct. 11, 1993 [BE] Belgium ..... 09301064

[51] Int. Cl.[6] ..... H05B 39/04

[52] U.S. Cl. ..... 315/106; 315/107; 315/105; 315/208; 315/244; 315/DIG. 7

[58] Field of Search ..... 315/101, 207, 315/208, 244, 225, 226, 307, DIG. 7, 94, 98, 100, 105, 106, 107

[56] References Cited

U.S. PATENT DOCUMENTS 3,919,590 10/1975 Remery et al. ..... 315/101
3,924,155 12/1975 Vogeli ..... 315/101 X
4,177,403 12/1979 Remery ..... 315/101
4,253,043 2/1981 Chemin et al. ..... 315/101 X
4,380,719 4/1983 De Bijl et al. ..... 315/101

FOREIGN PATENT DOCUMENTS 2255776 7/1975 France .
159853 8/1972 Netherlands .

*Primary Examiner*—Robert J. Pascal
*Assistant Examiner*—Haissa Philogene
*Attorney, Agent, or Firm*—Edward Blocker

[57] ABSTRACT

A circuit arrangement for preheating electrodes of a discharge lamp connected in series with a ballast by means of a supply voltage of alternating polarity. The circuit arrangement is provided with a switching element (S) which shunts the lamp and which is operated by means of a control signal. A circuit portion (II) adjusts both the phase and the frequency of the control signal in dependence on whether the ballast is inductive or capacitive. The electrodes of the lamp are preheated in a short period both for an inductive ballast and for a capacitive ballast.

18 Claims, 3 Drawing Sheets

DISCHARGE LAMP FAST PREHEAT CIRCUIT INDEPENDENT OF TYPE OF BALLAST

BACKGROUND OF THE INVENTION

The present invention relates to a circuit arrangement for preheating electrodes of a discharge lamp connected in series with a ballast by means of a supply voltage of alternating polarity, comprising

- a branch A for connection to the electrodes of the discharge lamp, which branch A comprises a switching element,
- a control circuit coupled to a control electrode of the switching element for generating a control signal to render the switching element conducting during preheating in each cycle of the supply voltage,
- a circuit portion I coupled to the control circuit for influencing the control signal in dependence on whether the ballast is inductive or capacitive.

Such a circuit arrangement is known from Netherlands Patent Application 159853 laid open to public inspection. In the known circuit arrangement, the circuit portion I comprises a branch which includes a transistor. The control signal is influenced in that this transistor becomes conducting exclusively if the ballast is capacitive. It is realised by means of this branch that instability in the operation of the circuit arrangement in the case of a capacitive ballast is avoided. The known circuit arrangement can accordingly be used in combination with both inductive ballasts and capacitive ballasts. A disadvantage of the known circuit arrangement, however, is that the effective value of the current through branch A, with which the lamp electrodes are preheated, is comparatively low. The result of this is that it takes a comparatively long time before the electrodes of the discharge lamp have reached a temperature at which a sufficient emission of electrons occurs for igniting the discharge lamp at the given ignition voltage. This comparatively long preheating time is felt to be inconvenient by users.

SUMMARY OF THE INVENTION

The invention has for its object to provide a circuit arrangement with which the electrodes of a discharge lamp can be preheated in a comparatively short time, both when the ballast connected in series with the discharge lamp is inductive and when this ballast is capacitive.

According to the invention, a circuit arrangement as described in the opening paragraph is for this purpose characterized in that the circuit portion I comprises a circuit portion II for adjusting both the phase and the frequency of the control signal. The phase of the control signal is here understood to mean the time interval between the moment at which the control signal renders the switching element conducting and an immediately preceding polarity change of the supply voltage. It is possible through a suitable choice of the phase and frequency of the control signal to cause the preheating current through the electrodes of the discharge lamp to be greater than the short-circuit current both with the use of an inductive ballast and with the use of a capacitive ballast. The short-circuit current is here understood to mean the current which would flow through the lamp electrodes if the switching element were continuously conducting. It was found to be possible by means of a circuit arrangement according to the invention to preheat the electrodes of a discharge lamp comparatively quickly, even when the amplitude of the supply voltage is comparatively low.

It was also found that a comparatively high preheating current can be realised when the frequency of the control signal, in the case of an inductive ballast, is equal to the frequency of the supply voltage and, in the case of a capacitive ballast, is equal to twice the frequency of the supply voltage.

It can be realised through a suitable choice of phase and frequency of the control signal that the effective value of the current flowing through the electrodes of the discharge lamp during preheating is substantially independent of whether the ballast is inductive or capacitive. It is achieved thereby that a discharge lamp in series with an inductive ballast can be ignited after a same time interval as a discharge lamp in series with a capacitive ballast. In other words, the circuit arrangement requires no adaptations depending on whether the ballast is inductive or capacitive.

An advantageous embodiment of a circuit arrangement according to the invention is characterized in that the circuit arrangement is provided with means for generating a first current pulse by making the switching element conductive before preheating, and means for adjusting the phase and frequency of the control signal in dependence on the amplitude of the first current pulse. In such a circuit arrangement, it is ascertained in a comparatively simple and also quick way, substantially immediately after switching-on of the supply voltage, whether the ballast in series with the discharge lamp is capacitive or inductive, and the phase and frequency of the control signal are adjusted accordingly.

It was found that the circuit arrangement according to the invention can be realised in a comparatively simple manner when the branch A comprises a diode bridge.

It was also found to be advantageous that the branch A comprises a current sensor which forms part of the circuit portion I.

In proportion as the nominal power consumed by a discharge lamp decreases, the impedance of the ballast used in combination with the discharge lamp increases. It may be desirable to adjust the phase of the control signal for realising the same effective value of the preheating current through the electrodes of the discharge lamp by means of the same circuit arrangement for discharge lamps of differing nominal power ratings, in spite of this increase in impedance. This adjustment can be realised in a simple manner when the circuit arrangement II for adjusting the phase of the control signal comprises an adjustable timer circuit, i.e. in that the timer circuit is set. Thanks to the possibility of adapting the phase of the control signal, the circuit arrangement is suitable for the use in combination with discharge lamps of widely differing power ratings. An adjustable timer circuit may be realised in a comparatively simple and inexpensive manner through the use of an oscillator with an adjustable frequency.

BRIEF DESCRIPTION OF THE DRAWING

Embodiments of the invention will be explained with reference to the accompanying drawing in which.

1, both when an inductive ballast is used and when a capacitive ballast is used.

DESCRIPTION OF THE PREFERRED EMBODIMENTS

Figure 1:
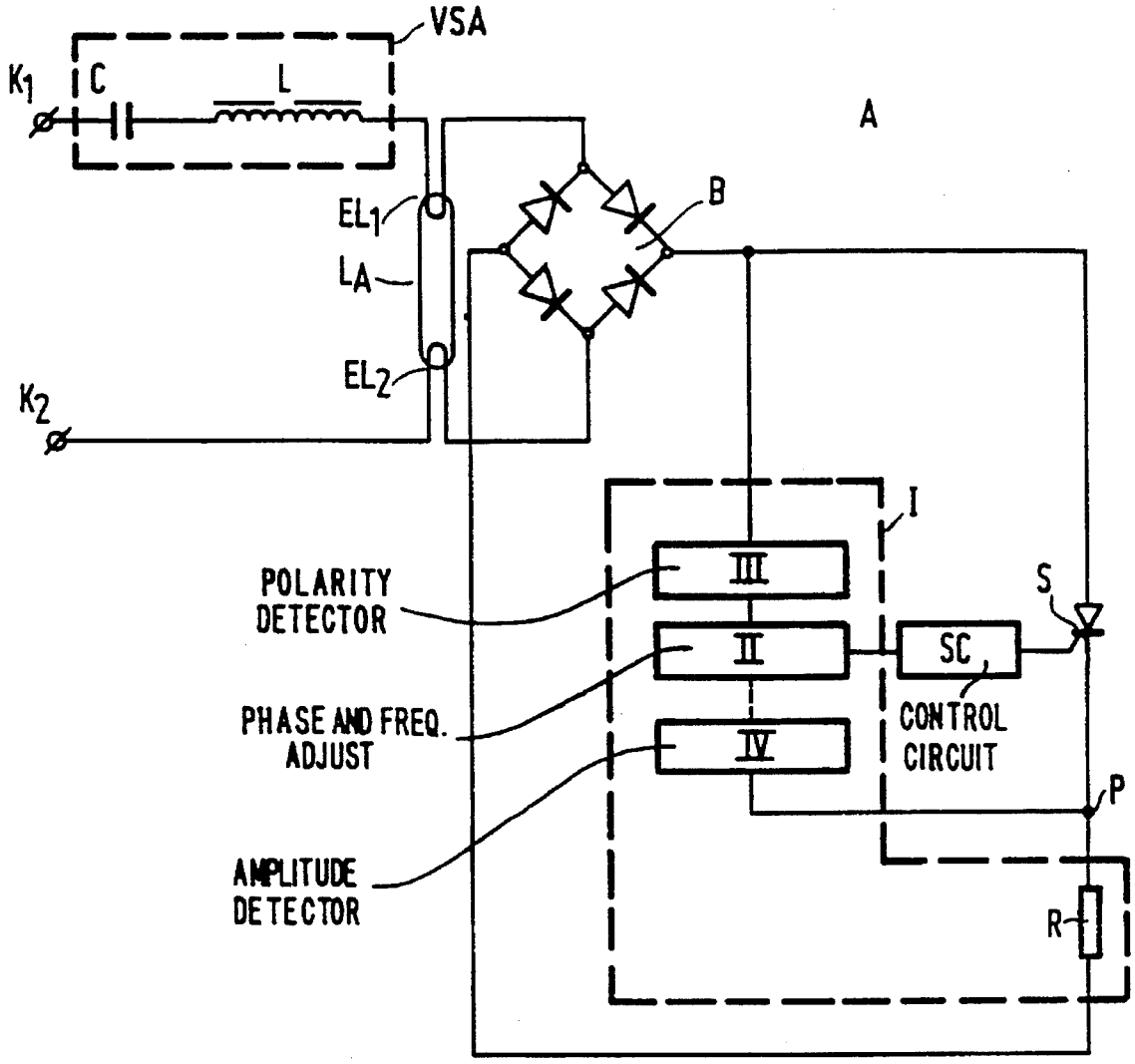
FIG. 1 is a diagram of the construction of an embodiment of a circuit arrangement according to the invention, coupled to a discharge lamp and a ballast.

In FIG. 1, diode bridge B, circuit portion I, control circuit SC and switching element S form a circuit arrangement for preheating and igniting a discharge lamp $L_A$ connected in series with a ballast by means of a supply voltage of alternating polarity. The discharge lamp $L_A$ is provided with electrodes El1 and El2 coupled to the circuit arrangement. Capacitor C and coil L together form a capacitive ballast VSA and K1 and K2 are terminals for connection to the supply voltage. The circuit arrangement also comprises means (not shown) for generating an ignition pulse after preheating of the electrodes of the lamp La. Diode bridge B, switching element S and ohmic resistor R form a branch A. SC is a control circuit for generating a control signal for rendering the switching element S conducting during preheating in each cyle of the supply voltage. Circuit portion I is coupled to the control circuit for influencing the control signal in dependence on whether the ballast used for the lamp is inductive or capacitive. Circuit portion I comprises for this purpose a circuit portion II for adjusting both the phase and the frequency of a control signal generated by the control circuit. In addition, the circuit portion I comprises a circuit portion III for detecting polarity changes of the supply voltage and a circuit portion IV for detecting whether the ballast connected in series with the discharge lamp La is capacitive or inductive. The construction of the circuit shown in FIG. 1 is as follows. Terminal K1 is connected to a first end of electrode Ell via a series circuit of capacitor C and coil L. Terminal K2 is connected to a first end of electrode El2. A further end of electrode Ell is connected to a first input of diode bridge B and a further end of electrode El2 is connected to a further input of diode bridge B. A first output terminal of diode bridge B is connected to a further output of diode bridge B via a series circuit of ohmic resistor R and switching element S. A common junction point of ohmic resistor R and switching element S is connected to an input of circuit portion IV. Circuit portion IV is coupled to circuit portion II. This coupling is indicated in FIG. 1 with a broken line. An input of circuit portion III is connected to an output of diode bridge B. An output of circuit portion III is connected to an input of circuit portion II. An output of circuit portion II is connected to an input of the control circuit SC and an output of control circuit SC is connected to a control electrode of the switching element S.

The operation of the circuit arrangement shown in FIG. 1 is as follows.

Immediately after a supply voltage of alternating polarity has been connected, the means II set the phase of the control signal to a first value. The switching element S is rendered conducting once at this first phase value. This first value is chosen so that the amplitude of the current pulse flowing through the electrodes of the lamp and the ohmic resistor R as a result of the switching element S becoming conducting is considerably higher when the ballast is inductive than when the ballast is capacitive. Immediately after the switching element S has been made conducting for the first time, the means II adjust the phase and frequency of the control signal to values suitable for a capacitive ballast. The circuit portion IV detects the amplitude of the first current pulse through the ohmic resistor R. If the ballast is capacitive, the first current pulse has a comparatively great amplitude and it is not necessary to change the control signal. If the ballast is inductive, however, the amplitude of the first current pulse is comparatively small. This comparatively small amplitude is detected by the circuit portion IV and it is achieved by means of a signal through the output of circuit portion IV that the circuit portion II adjusts the phase and frequency of the control signal to values suitable for an inductive ballast. With this new adjustment of phase and frequency of the control signal, the preheating current for use with an inductive ballast has a comparatively great amplitude. It is conceivable that, owing to a defect in circuit portion IV and/or circuit portion II, the phase and frequency of the control signal are not set for values suitable for an inductive ballast even though the ballast is indeed inductive. In that case the preheating current will have a comparatively low effective value because the switching element S is made conducting by means of a control signal whose phase and frequency are set for values suitable for a capacitive ballast, whereas in fact the ballast is inductive. If the means II were to set the phase and frequency of the control signal for values suitable for an inductive ballast immediately after the switching element S was made conducting for the first time, then a defect in circuit portion IV and/or circuit portion II could cause a very high preheating current whereby, for example, the operational life of the circuit arrangement and/or the discharge lamp could be adversely affected. This very high preheating current occurs when the switching element S is made conducting by means of a control signal whose phase and frequency are set for values suitable for an inductive ballast whereas in fact the ballast is a capacitive one. The occurrence of such high preheating currents can be prevented, also in the case of a defect in circuit portion IV and/or circuit portion II, in that the phase and frequency of the control signal are set for values suitable for a capacitive ballast, as described above, immediately after the switching element S has been made conducting for the first time.

The control signal subsequently makes the switching element S conducting in each cycle of the supply voltage during preheating. As a result of the conducting state of the switching element S caused by the control signal, a preheating current flows through the electrodes El1 and El2 of the discharge lamp La. Whenever the amplitude of this preheating current becomes substantially equal to zero, the switching element S becomes non-conducting. Circuit portion III generates a square-wave signal during preheating which changes from high to low or from low to high at a zero passage of the supply voltage. This square-wave signal is used for resetting a timer circuit which is not shown in FIG. 1. It is possible to control the phase of the control signal through this timer circuit.

Figure 2:
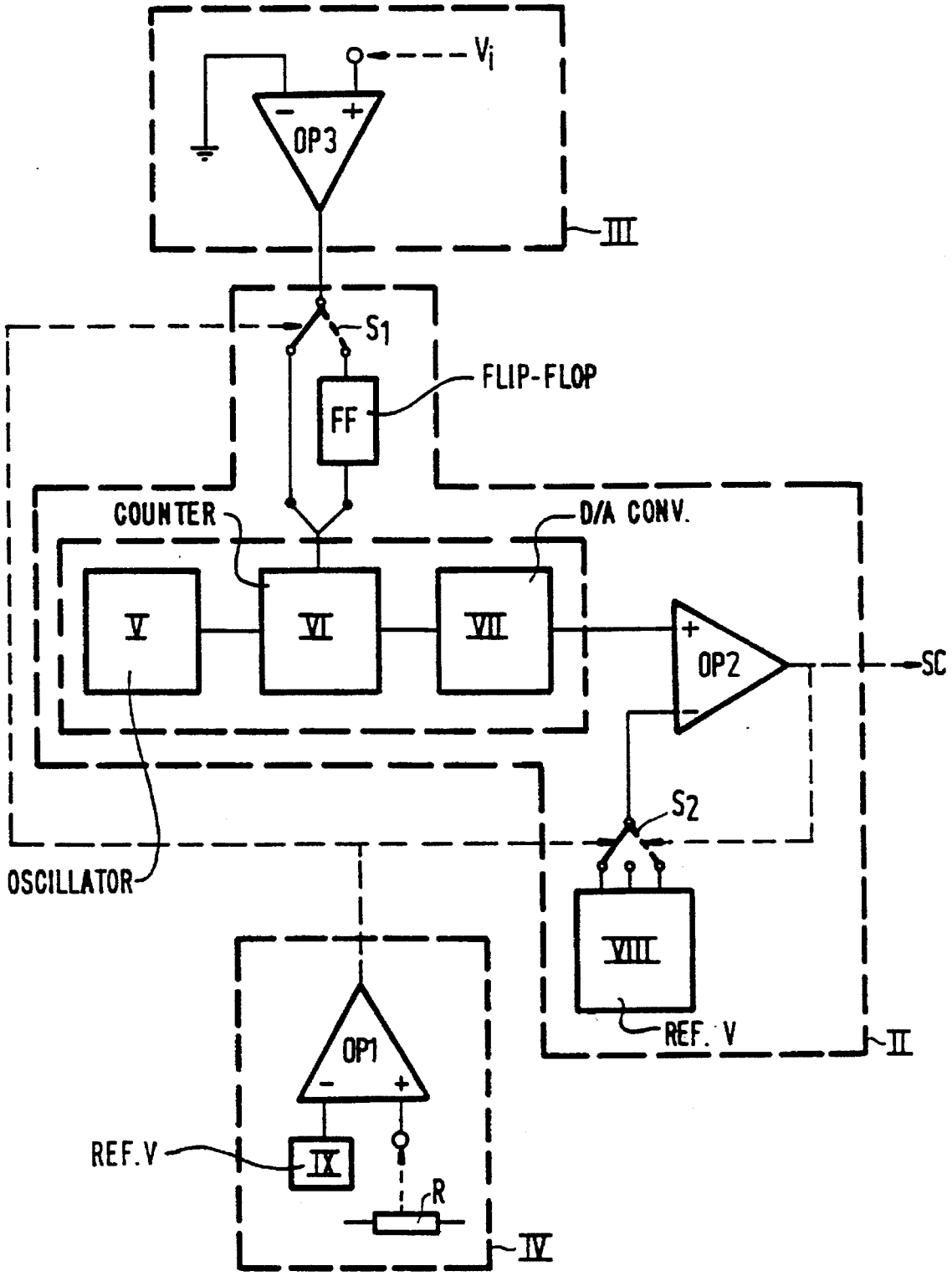
FIG. 2 shows a portion of the circuit arrangement shown in FIG. 1 in more detail.

FIG. 2 shows the circuit portions II, III and IV in more detail. In FIG. 2, Op1, Op2 and Op3 designate operational amplifiers, S1 and S2 are switching elements and FF is a bistable multivibrator. V is an oscillator and VI is a counter for counting the number of oscillations of the oscillator V. VII is a digital-analog converter. Oscillator V, counter VI and digital-analog converter VII together form a timer circuit. VIII and IX are reference voltage sources. Circuit portion II in this embodiment is formed by oscillator V, counter VI, digital-analog converter VII, reference voltage source VIII, operational amplifier Op2, bistable multivibrator FF, and switching elements S1 and S2. Circuit portion III is formed by operational amplifier Op3, and circuit portion IV by operational amplifier Op 1, reference voltage source IX and ohmic resistor R. The construction of the circuit portion shown in FIG. 2 is as follows. Respective inputs of operational amplifier Op3 are coupled to respective poles of the supply voltage source. An output of operational amplifier Op3 is connected to a first main electrode of switching element S1. A second main electrode of switching element S1 is connected to a first input of circuit portion VI. A third main electrode of the switching element S1 is connected to an input of bistable multivibrator FF. An output of bistable multivibrator FF is connected to the first input of circuit portion VI. An output of circuit portion V is connected to a further input of circuit portion VI. An output of circuit portion VI is connected to an input of circuit portion VII. An output of circuit portion VII is connected to a first input of operational amplifier Op2. An output of operational amplifier Op2 is connected to an input of the control circuit SC. The output of operational amplifier Op2 is also coupled to a control electrode of switching element S2. This coupling is indicated in FIG. 2 with a broken line. A further input of operational amplifier Op2 is connected to a main electrode of switching element S2. A first output of circuit portion VIII is connected to a second main electrode of switching element S2. A second output of circuit portion VIII is connected to a third main electrode of the switching element S2. A third output of circuit portion VIII is connected to a fourth main electrode of switching dement S2. An output of reference voltage source IX is connected to a first input of operational amplifier Op1. A second input of operational amplifier Op1 is coupled to the resistor R via the point P indicated in FIG. 1. An output of operational amplifier Op1 is coupled to a control electrode of switching element S1 and to a control electrode of switching element S2. These couplings are indicated in FIG. 2 with broken lines.

The operation of the circuit shown in FIG. 2 is as follows.

When a supply voltage of alternating polarity is present between the terminals K1 and K2 shown in FIG. 1, the voltage present at the output of operational amplifier Op3 changes from low to high or from high to low at each polarity change of the supply voltage. Immediately after switching-on of the supply voltage, the switching element S1 is in a first state in which it connects the output of operational amplifier Op3 directly to the first input of counter VI. Thus, a signal is present at the first input of counter VI whose frequency is equal to the frequency of the supply voltage. The counter VI is reset at each rising or falling edge of the signal present at the first input of counter VI. The counter comprises a digital memory in which a number is present which is equal to the number of oscillations of the oscillator V since the latest reset. This number is converted in the digital-analog converter VII into an analog signal which is applied to the first input of operational amplifier Op2 and which is a measure of the time interval which has elapsed since the polarity change of the supply voltage which coincided in time substantially with resetting of the counter VI. Immediately after switching-on of the circuit arrangement, the switching element S2 is in a first state in which it connects the first output of reference voltage source VIII to the further input of operational amplifier Op2. As a result, a first reference voltage which is a measure of a desired value of the phase of the control signal is applied to the further input of operational amplifier Op2. This desired value corresponds to the said first value of the phase of the control signal immediately after switching-on of the circuit arrangement. Switching element S is made conducting in that the voltage present at the output of operational amplifier Op2 changes from low to high when the analog signal at the first input of operational amplifier Op2 becomes equal to the reference voltage applied to the further input. This change in the voltage present at the output of operational amplifier Op2 is converted by the control circuit SC into a signal with which the switching element S is made conducting. The switching element S2 is brought into a second state by the change of the output voltage of operational amplifier Op2 via the coupling between switching element S2 and the output of operational amplifier Op2. In the second state, the second output of reference voltage source VIII is connected to the further input of operational amplifier Op2, so that a second reference voltage is present at this further input. The second reference voltage is chosen so that a preheating current with a comparatively great amplitude is obtained with the use of a capacitive ballast. The coupling between the output of operational amplifier Op2 and switching element S2 is such that exclusively the first change in the output voltage of operational amplifier Op2 causes a change in the state of switching element S2. Since switching element S1 is in the first state, the frequency of the signal applied to the first input of counter VI is equal to the frequency of the supply voltage. The result is that the counter VI is reset twice every cycle of the supply voltage, so that also the switching element S is made conducting twice every cycle of the supply voltage. If the ballast is capacitive, the amplitude of the voltage pulse generated by the first current pulse across the resistor R is lower than the reference voltage generated by reference voltage source IX. As a result, the voltage present at the output of operational amplifier Op1 is comparatively low, so that the switching elements S1 and S2 are kept in their first and second state, respectively. If the ballast used is an inductive one, however, the amplitude of the voltage pulse generated by the first current pulse across the resistor R is higher than the reference voltage generated by the reference voltage source IX, so that the voltage at the output of operational amplifier Op1 is comparatively high. This comparatively high value is used as a signal for bringing the switching elements S1 and S2 into a second and third state, respectively, via the connections between the output of operational amplifier Op1 and the control terminals of said switching elements. In the second state, switching element S1 connects the output of operational amplifier Op3 to the first input of counter VI via bistable multivibrator FF. As a result, a signal is present at the first input of counter VI whose frequency is only half the frequency of the supply voltage. The result is that the counter VI is reset only once every supply voltage cycle, and the switching element S is made conducting only once every supply voltage cycle. The switching element S2 in its third state connects the third output of reference voltage source VIII to the further input of operational amplifier Op2. A third reference voltage delivered at the third output of reference voltage source VIII is chosen so that a preheating current with a comparatively great amplitude is obtained for the use of an inductive ballast.

The phase of the control signal can be changed in that the second and third reference voltages, generated by the reference voltage source VIII, are changed. Depending on the construction of the oscillator and the reference voltage source VIII, however, it is often simpler in practice to change the frequency of the oscillator V.

Figure 3A:
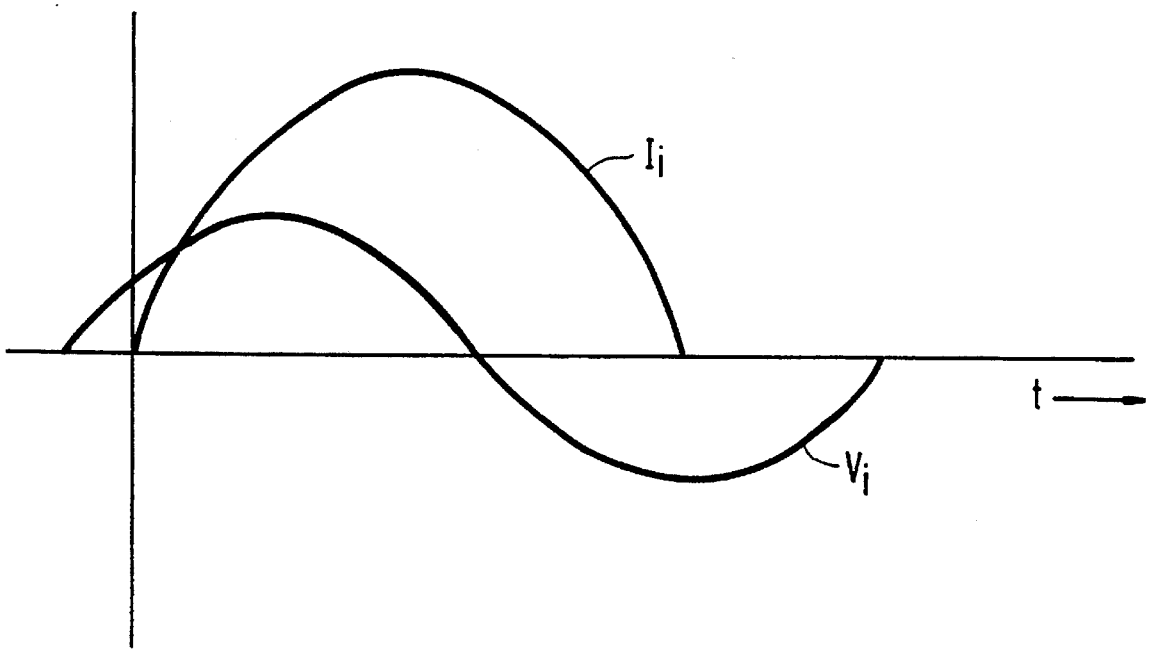
FIG. 3(*a* and *b*) shows the waveforms of the preheating current generated by the circuit arrangement shown in FIG.
Figure 3B:
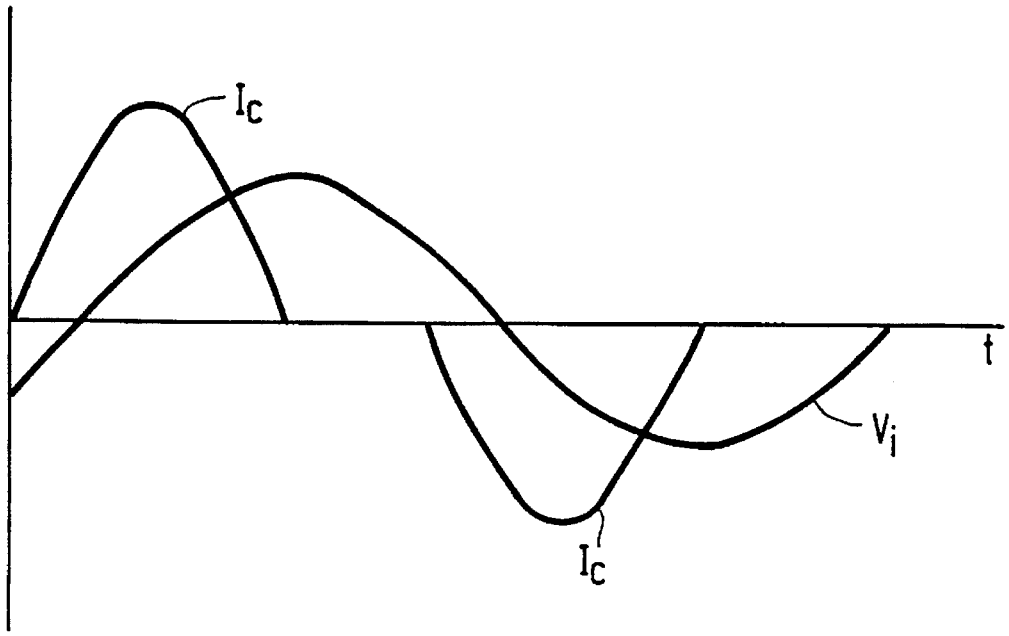

FIG. 3*a* shows the waveform of the supply voltage Vi and of the preheating current Ii generated by the circuit arrangement shown in FIG. 1 as a function of time when the ballast used is an inductive one. A pulsatory preheating current with a comparatively high effective value is realised in that the switching element S is made conducting once in every cycle of the supply voltage Vi at the phase of VI shown. FIG. 3*b* shows the waveform of the supply voltage Vi and of the preheating current Ic generated by the circuit arrangement shown in FIG. 1 as a function of time when a capacitive ballast is used. The switching element S is made conducting twice in every cycle of the supply voltage Vi. The preheating current is pulsatory also with the use of a capacitive ballast and has a comparatively high effective value. In this latter case, there are two current pulses in each cycle of the supply voltage Vi.

Using a sinusoidal supply voltage with a frequency of 50 Hz, a discharge lamp with a power rating of 40 W and a practical embodiment of a circuit arrangement according to the invention as shown in FIGS. 1 and 2, it was found to be possible, both with the use of an inductive ballast and with the use of a capacitive ballast, to preheat the electrodes of the discharge lamp within one second, even when the effective value of the supply voltage was 10% lower than the most common value of 220 V. It was also found that the same favourable performance could be realised with the same circuit arrangement for discharge lamps having power ratings from 40 to 80 W by adjusting the oscillator frequency in dependence on the lamp's power rating.

We claim:

1. A circuit arrangement for preheating electrodes of a discharge lamp connected in series with a ballast by means of a supply voltage of alternating polarity, comprising;

a branch circuit for connection to the electrodes of the discharge lamp, which branch circuit comprises a switching element, a control circuit coupled to a control electrode of the switching element for generating a control signal to render the switching element conductive during preheating in each cycle of the supply voltage, a first circuit coupled to the control circuit for governing the control signal in dependence on whether the ballast is inductive or capacitive, and wherein the first circuit comprises a second circuit for adjusting both the phase and the frequency of the control signal.

2. A circuit arrangement as claimed in claim 1, wherein the frequency of the control signal, in the case of an inductive ballast, is equal to the frequency of the supply voltage and, in the case of a capacitive ballast, is equal to twice the frequency of the supply voltage.

3. A circuit arrangement as claimed in claim 1, wherein the phase and frequency of the control signal are chosen so that the effective value of the current flowing through the electrodes of the discharge lamp during preheating is substantially independent of whether the ballast is inductive or capacitive.

4. A circuit arrangement as claimed in claim 1, further comprising means for generating a first current pulse by making the switching element conductive before preheating, and means for adjusting the phase and frequency of the control signal dependent upon the amplitude of the first current pulse.

5. A circuit arrangement as claimed in claim 1, wherein the branch circuit comprises a diode bridge.

6. A circuit arrangement as claimed in claim 1, wherein the first circuit comprises a current sensor in the branch circuit.

7. A circuit arrangement as claimed in claim 1, wherein the second circuit for adjusting the phase of the control signal, comprises an adjustable timer circuit.

8. A circuit arrangement as claimed in claim 7, wherein the adjustable timer circuit comprises an oscillator with an adjustable frequency.

9. A circuit for preheating the electrodes of a discharge lamp adapted for connection to a source of AC supply voltage via a series connected ballast having an inductive or a capacitive characteristic, set circuit comprising:

a branch circuit for connection to the lamp electrodes and which includes a controlled semiconductor switching element arranged to conduct a lamp electrode preheat current, a control circuit coupled to a control electrode of the semiconductor switching element for supplying thereto a control signal that governs conduction of the semiconductor switching element during a preheating period in each cycle of the AC supply voltage, a first circuit coupled to the control circuit and including means for modifying both the phase and the frequency of the control signal dependent on whether the ballast has an inductive or a capacitive characteristic, and wherein said first circuit further comprises means for detecting whether the series connected ballast has a capacitive or an inductive characteristic and for indicating same to said control signal modifying means.

10. The circuit as claimed in claim 9 wherein the first circuit supplies a further control signal to the control circuit such that the phase and frequency of the control signal supplied to the control electrode of the semiconductor switching element adjusts the switching element conduction time so that a preheat current flows through the lamp electrodes which is greater than the electrode short-circuit current.

11. The circuit as claimed in claim 9 wherein, on turn-on of the circuit, said first circuit initially adjusts the phase and frequency of the control signal to a value whereby the switching element provides a preheat current that is suitable for a capacitive ballast, and if the detecting means determines that the ballast is inductive, the first circuit adjusts the phase and the frequency of the control signal to a value whereby the switching element provides a preheat current suitable for the inductive ballast.

12. The circuit as claimed in claim 9 wherein the first circuit controls the frequency of said control signal such that it has a higher frequency for a capacitive ballast than for an inductive ballast.

13. The circuit as claimed in claim 9 wherein the first circuit controls the phase and frequency of said control signal such that the electrode preheat current is substantially independent of whether the ballast is inductive or capacitive.

14. The circuit as claimed in claim 9 further comprising a diode bridge coupling the lamp electrodes to the branch circuit so as to provide a symmetrical preheat circuit and hence a symmetrical preheat current flow in the lamp electrodes.

15. The circuit as claimed in claim 9 wherein said detecting means comprises a current sensing element connected in series with the semiconductor switching element to the lamp electrodes, and means controlled by the level of current in said sensing element for determining whether the ballast is inductive or capacitive and for signalling same to said control signal modifying means.

16. The circuit as claimed in claim 9 wherein said control signal modifying means includes an oscillator having an output coupled to a first input of a timer, and said first circuit further comprises, a zero crossing detector circuit responsive to a voltage indicative of the supply voltage, wherein said zero crossing detector has an output coupled to a reset input of said counter.

17. The circuit as claimed in claim 16 wherein said first circuit further comprises a switch controlled by said detecting means for selectively coupling said output of the zero crossing detector directly to said counter reset input or via a bistable circuit.

18. The circuit as claimed in claim 9 wherein said first circuit controls the frequency of said control signal to be equal to the AC supply voltage frequency for an inductive balance and to be equal to twice the AC supply voltage frequency for a capacitive ballast.

* * * * *